United States Patent [19]

Stover

[11] 4,256,081

[45] Mar. 17, 1981

[54] AIR CIRCULATION AND HUMIDIFICATION SYSTEM FOR STOVES

[76] Inventor: Michael L. Stover, 320 SE. Thornton, De Moines, Iowa 50315

[21] Appl. No.: 39,387

[22] Filed: May 16, 1979

[51] Int. Cl.[3] ..... F24D 9/00

[52] U.S. Cl. ..... 126/101; 126/113; 126/110 R

[58] Field of Search ..... 126/101, 110 R, 110 C, 126/113, 134, 350 B, 365

[56] References Cited

U.S. PATENT DOCUMENTS

| | | | |
|---|---|---|---|
| 1,254,189 | 1/1918 | Bahnson | 126/113 |
| 1,388,143 | 8/1921 | Hardie | 126/113 |
| 2,424,927 | 7/1947 | Garvey et al. | 126/113 |
| 2,482,964 | 9/1949 | Cohee | 126/113 |
| 4,054,122 | 10/1977 | Reed | 126/113 |

FOREIGN PATENT DOCUMENTS

| | | | |
|---|---|---|---|
| 387478 | 2/1933 | United Kingdom | 126/355 |

*Primary Examiner*—Carroll B. Dority, Jr.
*Assistant Examiner*—R. J. Marett
*Attorney, Agent, or Firm*—John A. Hamilton

[57] ABSTRACT

An air circulation and humidification system for stoves consisting of a steam generator heated by the stove itself, a steam-driven motor driven by the steam generator and operable to drive an air circulating fan, a controlled portion of the steam exhausted by the motor being directed into the hot air leaving the stove for humidification thereof.

8 Claims, 1 Drawing Figure

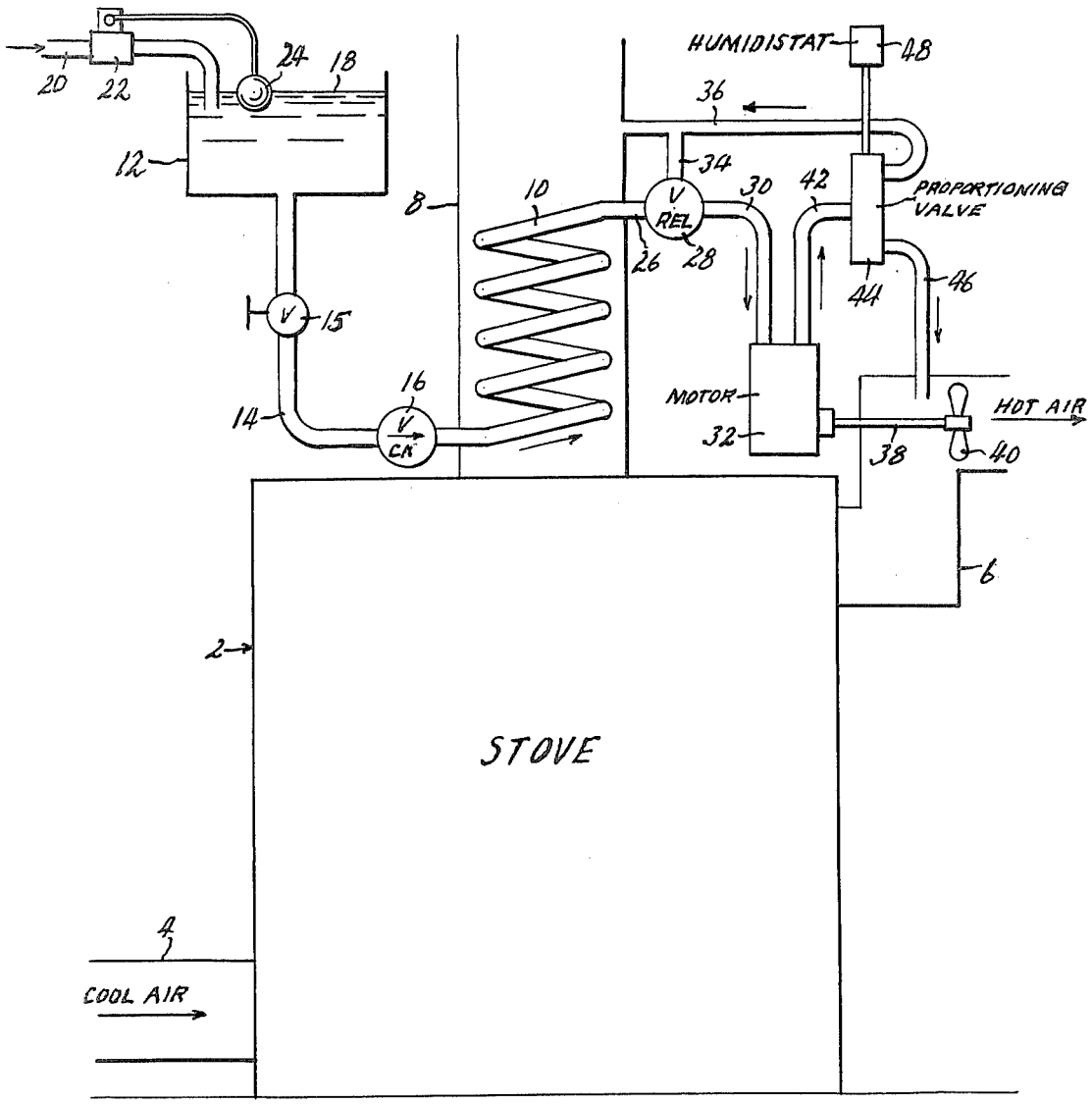
HUMIDISTAT
48
36
34
30
42
PROPORTIONING VALVE
10
V
REL
26
28
44
46
8
12
24
18
20
22
V
15
16
V
CK
14
MOTOR
32
38
40
HOT AIR
6
2
STOVE
4
COOL AIR

AIR CIRCULATION AND HUMIDIFICATION SYSTEM FOR STOVES

This invention relates to new and useful improvements in auxiliary equipment for stoves, and has particular reference to means for providing forced circulation and humidification of the hot air produced, particularly by coal and wood stoves, and particularly in rural or other areas in which electric power usually used in accomplishing these functions is not readily available, or simply as a means for reducing consumption of electric power.

The difficulties of maintaining proper circulation of the hot air produced by such a stove in the space to be heated, even within a single room in which the stove is disposed, are well known, hot and cold zones in the same room often being the case. The problem is of course multiplied if the same stove is called upon to heat a plurality of rooms. Likewise, such a stove of course produces hot air of very low humidity, which is uncomfortable to breathe, and which can cause respiratory troubles for persons breathing it.

Accordingly, the primary object of the present invention is the provision of auxiliary equipment which may be added to virtually any stove, and which includes means powered by the heat of the stove itself both to circulate and humidify the hot air output of the stove.

More specifically, an object of the present invention is the provision of a blower fan for providing forced circulation of the hot air output of the stove, said fan being powered by a steam-driven motor which is driven by steam generated by heat produced by the stove.

Another object is the provision of a system of the character described in which steam exhausted from the motor is fed into the hot air produced by the stove in order to humidify it.

A further object is the provision of a system of the character described having means insuring the delivery of a uniform supply of water to the steam generator, limiting the steam pressure generated for safety reasons, and for delivering the required amount of steam to the stove output of hot air to produce the desired degree of himidity.

Other objects are simplicity and economy of structure and efficiency and dependability of operation.

With these objects in view, as well as other objects which will appear in the course of the specification, reference will be had to the accompanying drawing, wherein the single view is a schematic diagram of an air circulation and humidification system for stoves, embodying the present invention.

In the drawing, the numeral 2 applies to an ordinary heating stove, the details of which may be standard, and are not shown. It may be fired by wood, coal, oil or any other suitable fuel, the particular type not being pertinent to the present invention. It includes a duct 4 through which relatively cool air to be heated enters, a duct 6 through which air heated thereby is discharged to the space to be heated, and a flue pipe 8 for conveying its gaseous products of combustion to a chimney or the like for discharge to the atmosphere, and for creating and maintaining an operating draft in the stove. The general stove structure thus far described is of course common and well known in the art.

In accordance with the present invention, there is provided a steam generating unit operable to generate steam by the heat of the stove itself. As shown, the steam generating unit consists of a tubular heating coil 10 enclosed within flue pipe 8 just above the stove. Ample heat for the purposes intended is available at this point, since much of the stove heat ordinarily does pass up the flue, and represents a heat loss. Other types of steam generating heat exchangers, disposed in different positions relative to the stove, could be used if desired, such for example as a small tube type boiler disposed within the stove.

Water is supplied to the lower end of coil 10 from a reservoir 12 external to the stove and flue pipe, through a conduit 14 in which is interposed a manually operable valve 15 which is closed when the stove is not operating, and a check valve 16 operable to permit water flow only toward coil 10. The water flow is by gravity, and the water head represented by the elevation of water level 18 in reservoir 12 above valve 16 determines the steam pressure which can be generated in coil 10. This pressure can be adjusted as desired by pre-determining the elevation at which reservoir 12 is installed. Water is supplied to the reservoir by a supply pipe 20 in which is interposed a float valve 22 which is controlled by a float 24 at water level 18 of the reservoir, whereby to maintain said water level constant, in a well known manner.

Steam generated in coil 10 passes through a conduit 26, a pressure relief valve 28 and conduit 30 to a steam-driven motor 32, preferably of the turbine type, whereby to drive said motor. Valve 28 is of a type which will vent the steam through conduits 34 and 36 back to flue pipe 8 for disposal, if the steam pressure rises for any reason to a level above that determined by reservoir water level 18, but still within safe limits, thereby protecting the system against possible damage by excess steam pressure. Motor 32, thus driven, turns a drive shaft 38 on which is mounted a blower fan 40, thereby turning said fan in a direction to blow air heated in the stove outwardly through duct 6. Duct 6 may of course discharge air directly into the room in which the stove is disposed, or may be connected to a ductwork system for conveying the hot air to a plurality of rooms.

The partially spent steam exhausted by motor 32 passes through a conduit 42 to a proportioning valve 44, which proportions and divides the steam flow to pass a part of it into duct 6 adjacent fan 40, whereby to humidify the hot air, through a conduit 46, and to pass a part of it to conduit 36 and flue pipe 8 for disposal. Of course, the amount of steam delivered to duct 6 must be controlled to provide the desired degree of humidity in the air discharged by said duct, and for this reason, valve 44 is regulated to vary the proportions of steam delivered respectively to duct 6 and flue pipe 8 by means of a humidistat 48 disposed in the space being served and responsive to the relative humidity in said space. In areas when the usual electric power is not available, or simply as a further energy conservation measure, humidistat 48 and valve 44 may be battery-operated. They consume very little electric power, and a single small battery could easily serve for a full heating season. Also, proportioning valve 44 could if desired be manually operated, at least where heating requirements remain relatively uniform and constant, but this would of course require attention by a human operator. With the humidistat control shown, the system is entirely automatic.

Operation of the system is believed to have been adequately described in connection with the foregoing description of its construction It provides for forced air circulation, and humidification, by means powered entirely by the stove itself, with no requirement for or reliance on any external source of power. The system may be applied to virtually any stove, and is entirely automatic, requiring no attention from human operators. It is economical in construction, and operates virtually entirely on heat energy which otherwise would be wasted to atmosphere through the flue pipe. A point not previously mentioned, but obvious, is that blower fan 40, in addition to assisting in the circulation of hot air in the space being served, also assists the normally gravity-induced flow of air through the stove itself, and thereby improves the efficiency and heat producing capacity of the stove.

While I have shown and described a specific embodiment of my invention, it will be readily apparent that many minor changes of structure and operation could be made without departing from the spirit of the invention.

What I claim as new and desire to protect by Letters Patent is:

1. A forced air circulation system for a stove having an inlet for air to be heated by said stove and an outlet for the heated air, said air circulation system comprising:

a. a steam generating unit adapted to be disposed within the stove structure, and operable by the heat of said stove to convert water to steam, b. means supplying water to said steam generating unit, c. a steam-driven motor, d. means supplying steam from said steam generating unit to said motor to drive the latter, and e. a blower fan disposed in the air outlet of said stove and operable by said motor to exhaust hot air from said stove.

2. A system as recited in claim 1 wherein said means supplying water to said steam generating unit comprises:

a. a water reservoir having a water level at a higher elevation than said steam generating unit, a conduit connecting a lower portion of said reservoir to said steam generating unit, and c. a check valve disposed in said conduit and operable to permit water flow therein toward said steam generating unit, but not in a reverse direction, whereby steam pressure generated in said generating unit is limited to a pressure determined by the water head between said reservoir water level and said check valve.

3. A system as recited in claim 2 with the addition of means operable to supply water to said reservoir at the same rate water flows therefrom to said steam generating unit, whereby the water level in said reservoir is maintained constant.

4. A system as recited in claim 2 with the addition of:

a. a conduit operable to supply water to said reservoir, and b. a float-operated valve disposed in said conduit and operable responsively to the water level in said reservoir to maintain said water level constant.

5. A system as recited in claim 1 wherein said stove includes a flue pipe operable to exhaust the gaseous products of combustion of said stove to atmosphere, and wherein said steam generating unit comprises a tubular heat exchanger coil disposed within said flue pipe.

6. A system as recited in claim 1 with the addition of means operable to deliver a portion of the spent steam exhausted by said motor to the hot air outlet of said stove, whereby to humidify said hot air.

7. A system as recited in claim 1 with the addition of:

a. a proportioning valve having an inlet and a pair of outlets, b. means delivering the spent steam exhausted by said motor to the inlet of said proportioning valve, c. conduits connecting the outlets of said proportioning valve respectively to the hot air outlet of said stove and to atmosphere, and d. means operable to control said proportioning valve to deliver said spent steam in varying proportions to the two outlets of said valve.

8. A system as recited in claim 7 wherein said control means for said proportioning valve comprises a humidistat disposed in the space served by said stove, whereby to set said valve to deliver a proportion of said steam to said stove hot air outlet sufficient to maintain a desired degree of humidity in said hot air.

* * * * *